US007307597B2

(12) United States Patent
Okayama

(10) Patent No.: US 7,307,597 B2
(45) Date of Patent: Dec. 11, 2007

(54) ANTENNA

(75) Inventor: Motoyuki Okayama, Takatsuki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/080,930

(22) Filed: Mar. 16, 2005

(65) Prior Publication Data

US 2005/0206574 A1 Sep. 22, 2005

(30) Foreign Application Priority Data

Mar. 17, 2004 (JP) ..... 2004-076219

(51) Int. Cl.
*H01Q 7/08* (2006.01)

(52) U.S. Cl. ..... 343/788

(58) Field of Classification Search ..... 343/895, 343/702, 700 MS, 785, 787, 788, 796, 802, 343/911 R See application file for complete search history.

(56) References Cited

U.S. PATENT DOCUMENTS 5,495,259 A * 2/1996 Lyasko ..... 343/788
6,064,351 A 5/2000 Mandai et al. ..... 343/873
6,288,680 B1 * 9/2001 Tsuru et al. ..... 343/702
6,745,057 B1 * 6/2004 Hankui ..... 455/575.5
6,862,003 B2 * 3/2005 Yoshinomoto et al. ..... 343/895
6,917,345 B2 * 7/2005 Hamada et al. ..... 343/895
6,995,710 B2 * 2/2006 Sugimoto et al. .... 343/700 MS
2006/0125475 A1 * 6/2006 Sodickson et al. ..... 324/300

* cited by examiner

*Primary Examiner*—Shih-Chao Chen
*Assistant Examiner*—Minh Dieu A
(74) *Attorney, Agent, or Firm*—Wenderoth, Lind & Ponack L.L.P.

(57) ABSTRACT

An antenna is provided which includes a radiation conductor; a basebody provided on the radiation conductor, and including a dielectric section made of a dielectric material and a magnetic section made of a magnetic material; and a power supplier connected to the radiation conductor, wherein the magnetic section is provided on a part where a current distribution of the radiation conductor is higher, and the dielectric section is provided on a part where a voltage distribution of the radiation conductor is higher.

6 Claims, 7 Drawing Sheets

ANTENNA

BACKGROUND OF THE INVENTION

1. Field of the Invention

The present invention relates to an antenna for use in various radio communications apparatuses.

2. Description of the Related Art

A small-sized antenna for use in various radio communications apparatuses such as a mobile phone is known, as shown in FIG. 7. This antenna includes a basebody 1 made of a dielectric or a magnetic material, a radiation conductor 2, and a power supplier 3 formed in the basebody 1 (for example, Japanese Patent Laid-Open Publication No. H10-247808).

However, in the case where the basebody 1 is made of mono dielectric material, mono magnetic material, or a mixture of mono dielectric material and mono magnetic material, the basebody 1 has a constant magnetism distribution or a constant permittivity distribution. For example, if the basebody is made of a mono dielectric material, the capacitive coupling of the radiation conductor 2 with a ground plate (not shown) is larger, whereby it makes it easier to form a loading capacity for wavelength compression at an open end 2*a*, but the impedance of the radiation conductor 2 itself is lower. As a result, it is necessary to set large a physical length of the radiation conductor 2 in order to secure its specified electrical length. Thus, it has been difficult to miniaturize the antenna.

SUMMARY OF THE INVENTION

It is an object of the present invention to provide a miniaturized antenna for use in various radio communications apparatuses, which is free from the problems residing in the prior art.

According to an aspect of the present invention, an antenna comprises: a radiation conductor; a basebody provided on the radiation conductor, and including a dielectric section made of a dielectric material and a magnetic section made of a magnetic material; and a power supplier connected to the radiation conductor, wherein: the magnetic section is provided on a part where a current distribution of the radiation conductor is higher, and the dielectric section is provided on a part where a voltage distribution of the radiation conductor is higher.

With this construction, the dielectric section is provided on an open end where the voltage distribution of the radiation conductor is larger and the quantity of electric energy in the radiation conductor is larger, thereby making it easier to form a loading capacity. The magnetic section is provided on a part connected to the power supplier where the current distribution of the radiation conductor is larger and the quantity of magnetic energy in the radiation conductor is larger, thereby increasing the impedance. Since the impedance of the radiation conductor differs between the part on which the dielectric section is provided and the part on which the magnetic section is provided, a wavelength compression effect for the radiation conductor can be efficiently secured. As a result, the antenna can be miniaturized.

These and other objects, features, aspects and advantages of the present invention will become more apparent from the following detailed description of the preferred embodiments/examples with reference to the accompanying drawings.

DESCRIPTION OF THE PREFERRED EMBODIMENTS

Preferred embodiments of the present invention will now be described with reference to the accompanying drawings.

Figure 1:
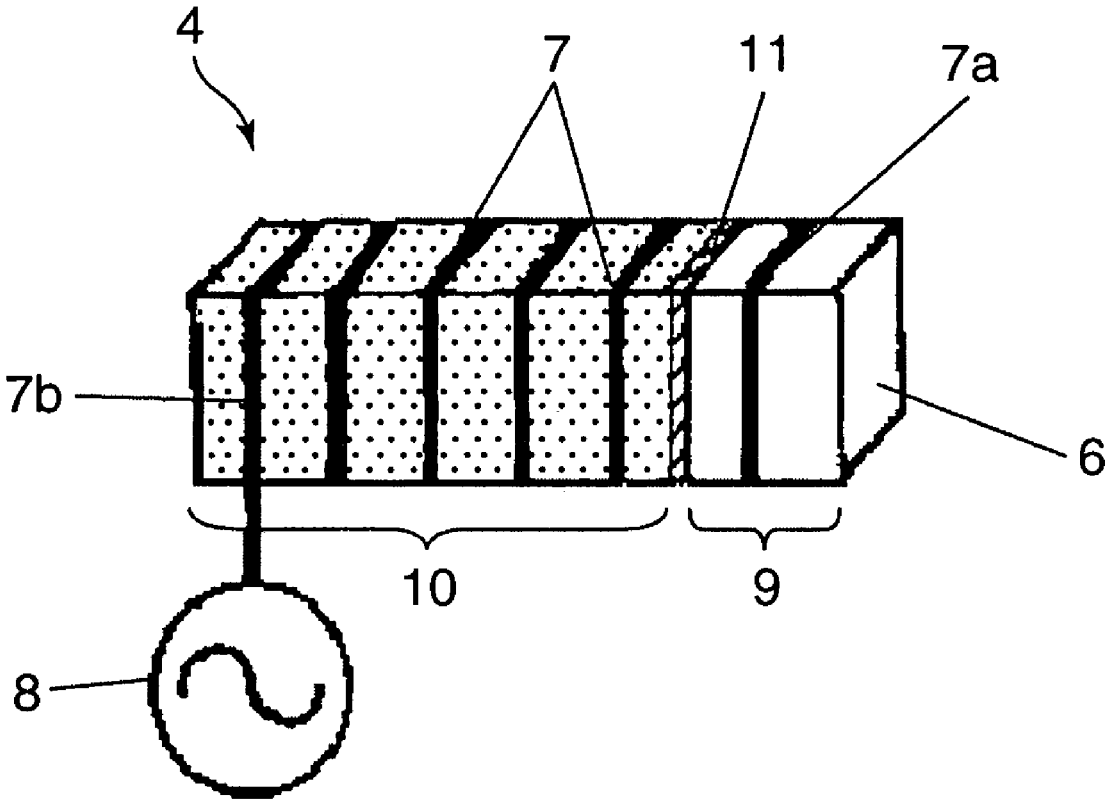
FIG. 1 is a perspective view of an antenna according to one embodiment of the invention.
Figure 2:
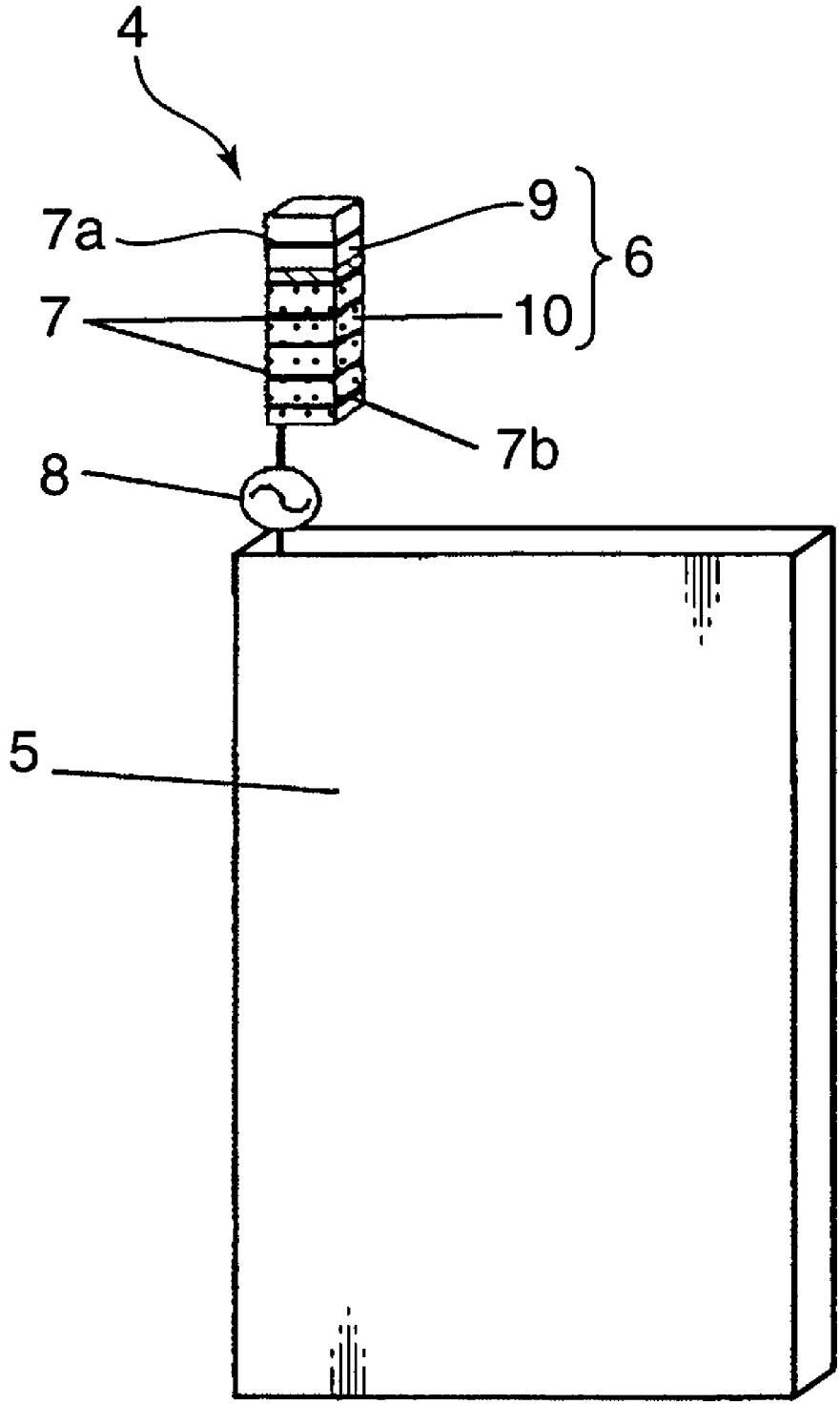
FIG. 2 is a perspective view of an antenna apparatus using the antenna shown in FIG. 1.

FIG. 1 is a perspective view of a small-sized antenna 4 for VHF/UHF bands according to one embodiment of the present invention, and FIG. 2 is a perspective view of an antenna apparatus in which the antenna 4 is connected with a ground plate 5.

The antenna 4 shown in FIG. 1 is a helical antenna in which a strip-shaped radiation conductor 7 is helically wound around the outer surfaces of a basebody 6 in the form of a rectangular parallelepiped. One end of the radiation conductor 7 is connected with a power supplier 8 while the other end thereof serves as an open end 7*a*, and the electrical length of the radiation conductor 7 is set to be $\lambda/4$ for one wavelength $\lambda$ at an applied frequency.

The basebody 6 of this antenna 4 is constructed by combining a dielectric section 9 made of a dielectric material mainly containing a titanium oxide, a copper oxide, an alumina etc. and a magnetic section 10 made of a magnetic material mainly containing an iron, a zinc, a cobalt, a barium etc.

The magnetic section 10 is arranged at a part corresponding to a portion where the current distribution of the radiation conductor 7 is larger, i.e. a portion connected with the power supplier 8 in the $\lambda/4$ type radiation conductor 7. The dielectric section 9 is arranged at a part corresponding to a portion where the voltage distribution of the radiation conductor 7 is larger, i.e. the remaining portion which is the open end 7*a* in the $\lambda/4$ type radiation conductor 7.

With this construction, the dielectric section 9 bears at a part in accordance with the open end of the radiation conductor 7 where the voltage distribution is larger and the quantity of electric energy is larger. This makes it easier to form a loading capacity by the open end 7*a* of the radiation conductor 7 and the ground plate 5 as shown in FIG. 2, thereby securing a wavelength compression effect for the radiation conductor 7. On the other hand, the magnetic section 10 bears at a part in accordance on the power supplier 8 side of the radiation conductor 7 where the current distribution is larger and the quantity of magnetic energy is larger. This makes it easier to give a higher permeability through the radiation conductor 7 in this side, thereby securing the wavelength compression effect for the radiation conductor 7. Further, since the impedance of the radiation conductor 7 differs between the part corresponding to the dielectric section 9 and the part corresponding to the magnetic section 10, which is similar to increasing an area at an open end of a conductor, the wavelength compression effect for the radiation conductor 7 can be secured by the function as a stepped impedance resonator (SIR).

Specifically, the base 6 is constructed by combining the dielectric section 9 made of the dielectric material with the magnetic section 10 made of the magnetic material. The magnetic section 10 is provided on the portion where the current distribution of the radiation conductor 7 is higher. The dielectric section 9 is provided on the portion where the voltage distribution of the radiation conductor 7 is higher. Thus, by combining the dielectric section 9 with the magnetic section 10, the radiation conductor 7 can be additionally provided with the SIR function in addition to the securement of the loading capacity for the radiation conductor 7 by the arrangement of the dielectric section 9 and the attainment of the wavelength compression through an improvement in the permeability through the radiation conductor 7 by the arrangement of the magnetic section 10. Therefore, the wavelength compression effect for the radiation conductor 7 can be efficiently secured, with the result that the antenna 4 can be efficiently miniaturized.

Figure 3:
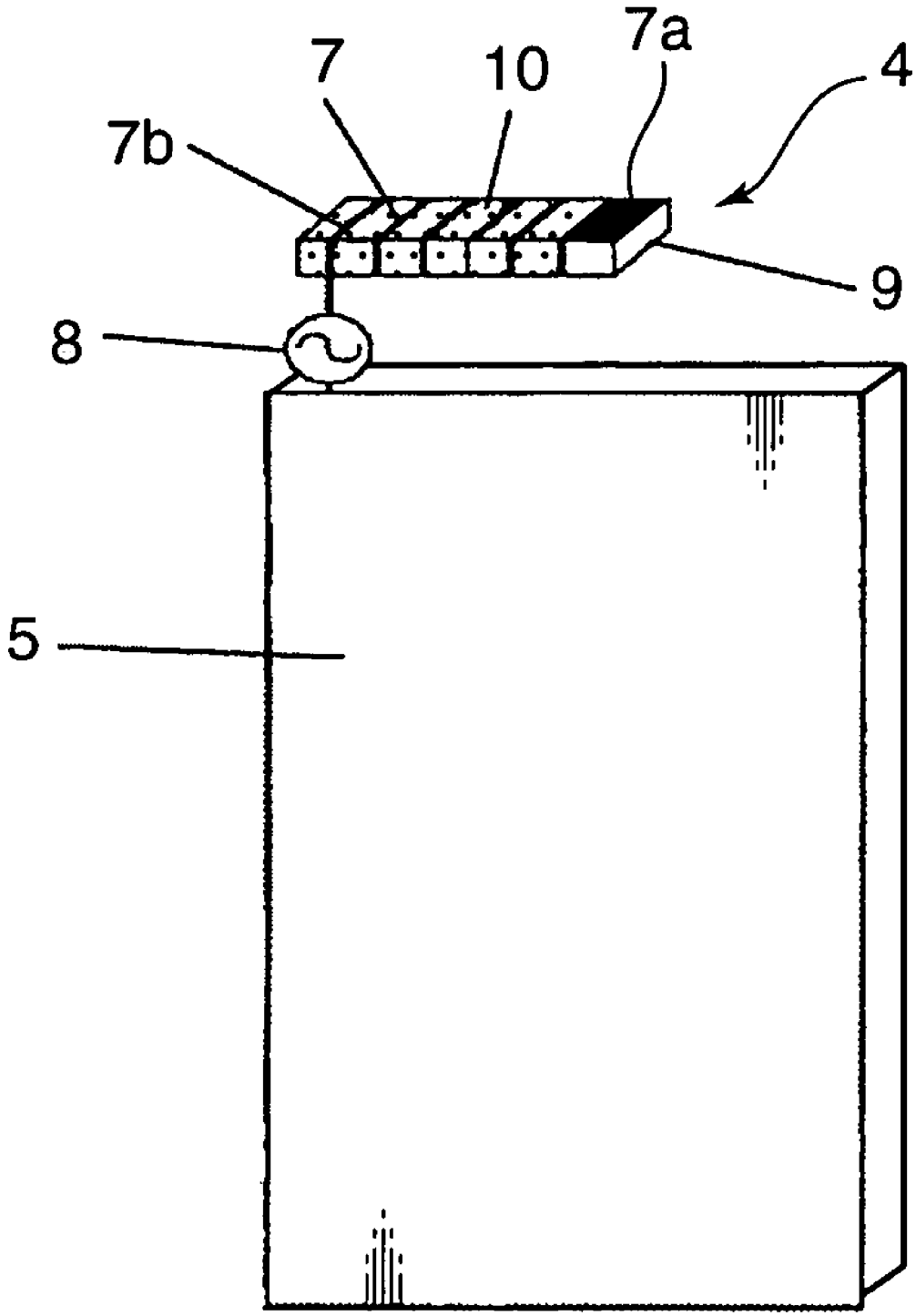
FIG. 3 is a perspective view of an antenna apparatus according to another embodiment of the invention.
Figure 5:
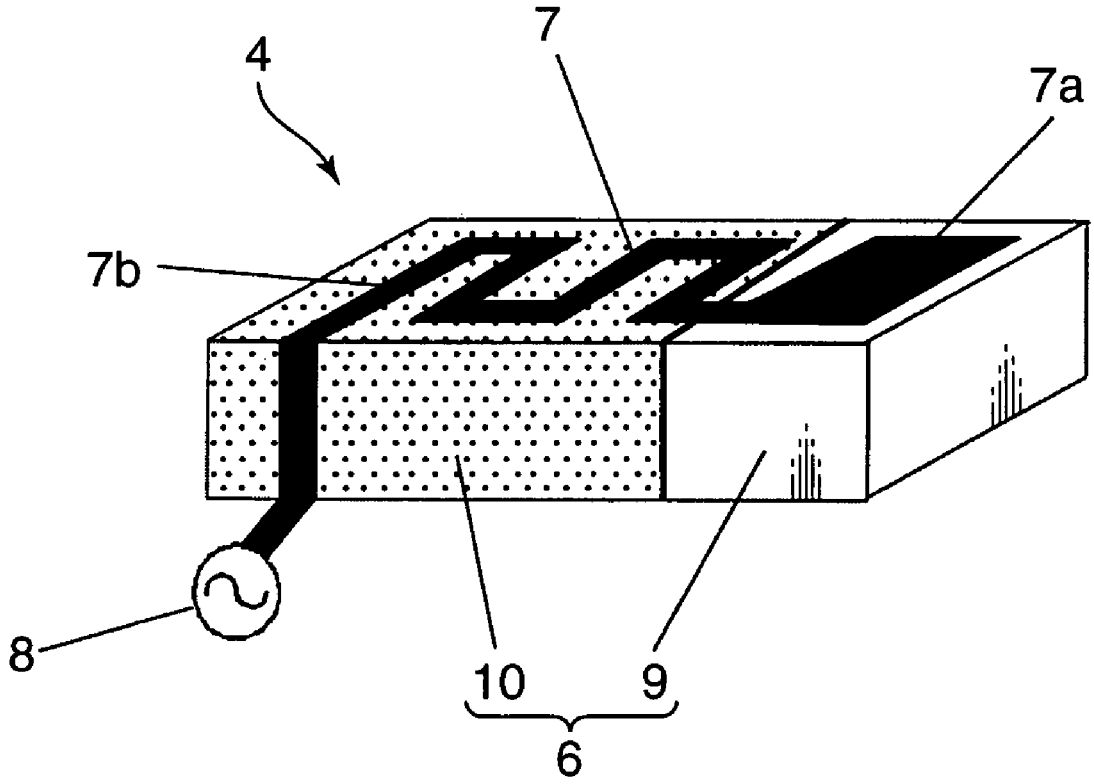
FIG. 5 is a perspective view of an antenna according to further another embodiment of the invention.

Although the one end 7*b* of the radiation conductor is connected with the power supplier and the other end 7*a* of the radiation conductor is open in this embodiment, the other end 7*a* may be connected with a trimming electrode (not shown), or may be as wide as a trimming electrode as shown in FIG. 3 or 5. With this construction, the electrical length of the antenna is easily adjusted to the applied frequency by adjusting the area of the trimming electrode or the width of the open end side of the radiation conductor.

Further, as a means for improving the SIR function of the radiation conductor 7, the width of the electrode at the open end side 7*a* of the radiation conductor 7 is set to be larger than the one at the power supply portion side 7*b* as shown in FIG. 3, whereby the radiation conductor 7 comes to possess an impedance changing point due to a difference in the width of the electrode, thereby securing the SIR function, and the loading capacity with the ground plate 5 can be increased by increasing the width of the electrode at the open end side 7*a*. Therefore, the antenna 4 can be made even smaller.

As another means for improving the SIR function of the radiation conductor 7, it is preferred that dielectric material and magnetic material meet the following relation:

$$\in_d \geqq \in_m \mu_m$$

where $\in_d$ is a relative permittivity of dielectric material, $\in_m$ is that of magnetic material, and $\mu_m$ is a relative magnetic permeability of magnetic material. With this construction, the loading capacity with the ground plate 5 can be increased by making a large difference in permittivity between the open end 7*a* and the power supply portion side 7*b*.

In the case of forming one basebody 6 using the dielectric section 9 and the magnetic section 10 as above, the mode of an electromagnetic field suddenly changes at a boundary between the dielectric section 9 and the magnetic section 10. If these sections 9, 10 are directly connected, an electric power cannot smoothly transfer in the radiation conductor 7, thereby deteriorating a radiation characteristic. Accordingly, it is preferable that an interference section 11 having permittivity and permeability lower than those of the dielectric and magnetic sections 9, 10 is provided between the dielectric section 9 and the magnetic section 10 as shown in FIG. 1. With this construction, the electric power can smoothly transfer in the radiation conductor 7, thereby suppressing the deterioration of the radiation characteristic of the antenna 4.

It is desirable to use a resin material as the material of this interference section 11 because this material should have permittivity and permeability lower than those of the dielectric section 9 and the magnetic section 10. An organic resin is preferable for a resin material. A resin adhesive is more preferably used upon uniting the dielectric section 9 and the magnetic section 10, whereby an adhesive layer formed by the adhesive functions as the interference section 11. Thus, the interference section 11 can be easily formed without being provided as another separate part between the dielectric section 9 and the magnetic section 10.

Figure 4:
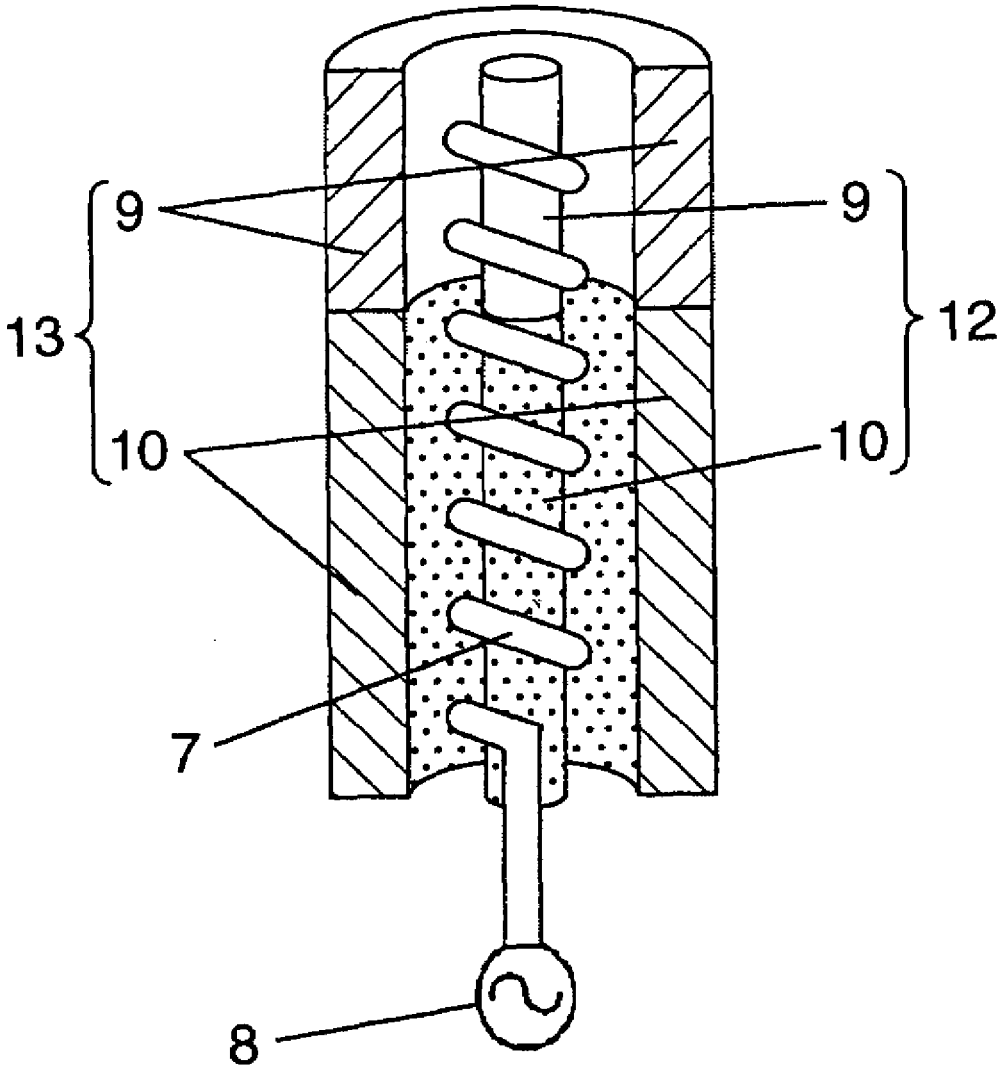
FIG. 4 is a diagram of an antenna according to still another embodiment of the invention.

Although the helical chip antenna 4 is described in the foregoing embodiment, similar effects can be obtained even if the basebody 6 is constructed by combining an inner portion and an outer portion. For example, as shown in FIG. 4, the radiation conductor 7 is a string-shaped element, the inner portion 12 is a shaft shape around which the radiation conductor 7 is wound, and the outer portion 13 is a tubular shape surrounding the outer circumferential surface of the inner portion 12. Each of the inner portion 12 and the outer portion 13 is formed by combining a dielectric section 9 and a magnetic section 10. Similar functions and effects can also be obtained in an antenna of the flat transmission line type in which the radiation conductor 7 is formed in a two-dimensional manner on a principal surface of the basebody 6 as shown in FIG. 5.

Figure 6:
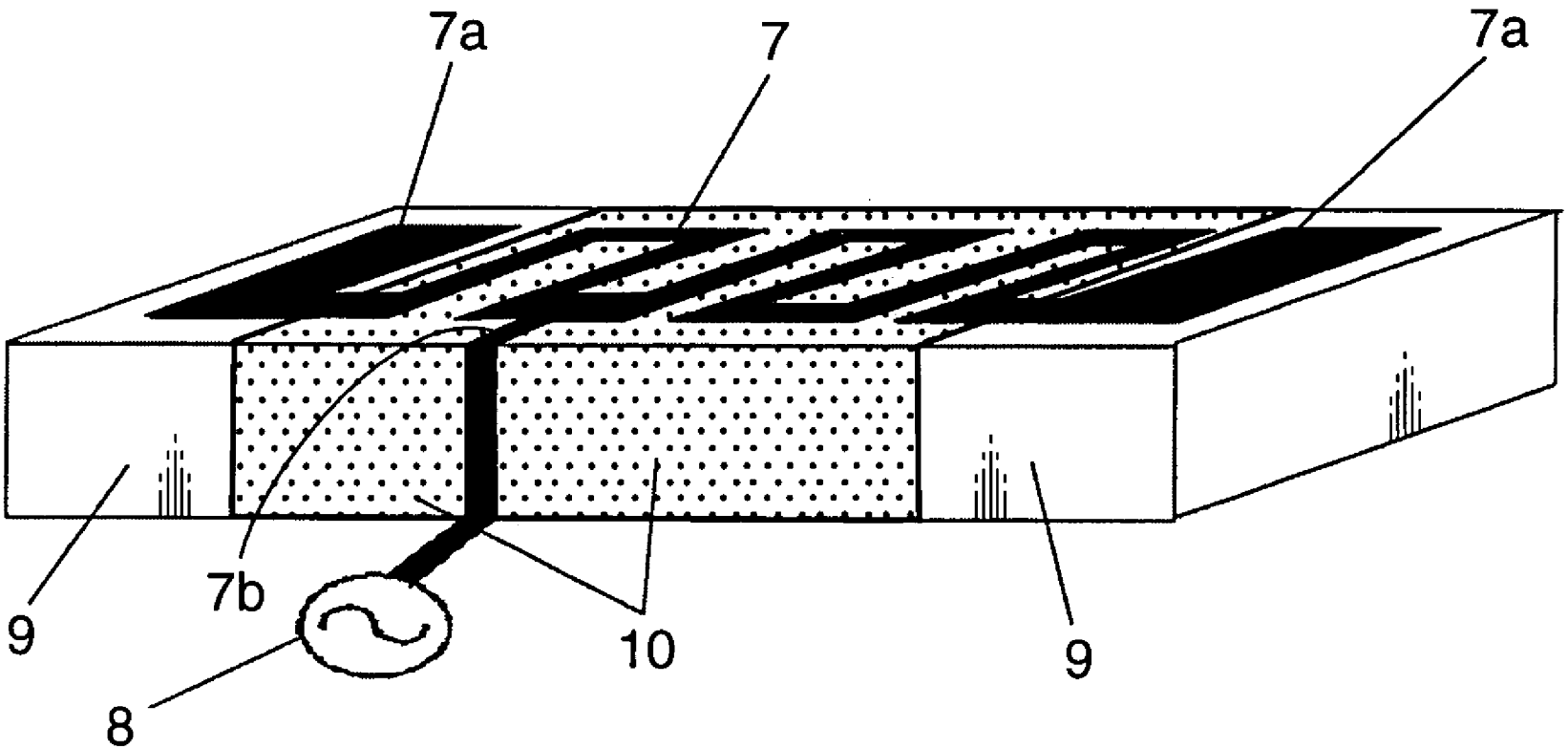
FIG. 6 is a perspective view of an antenna according to still further another embodiment of the invention.
Figure 7:
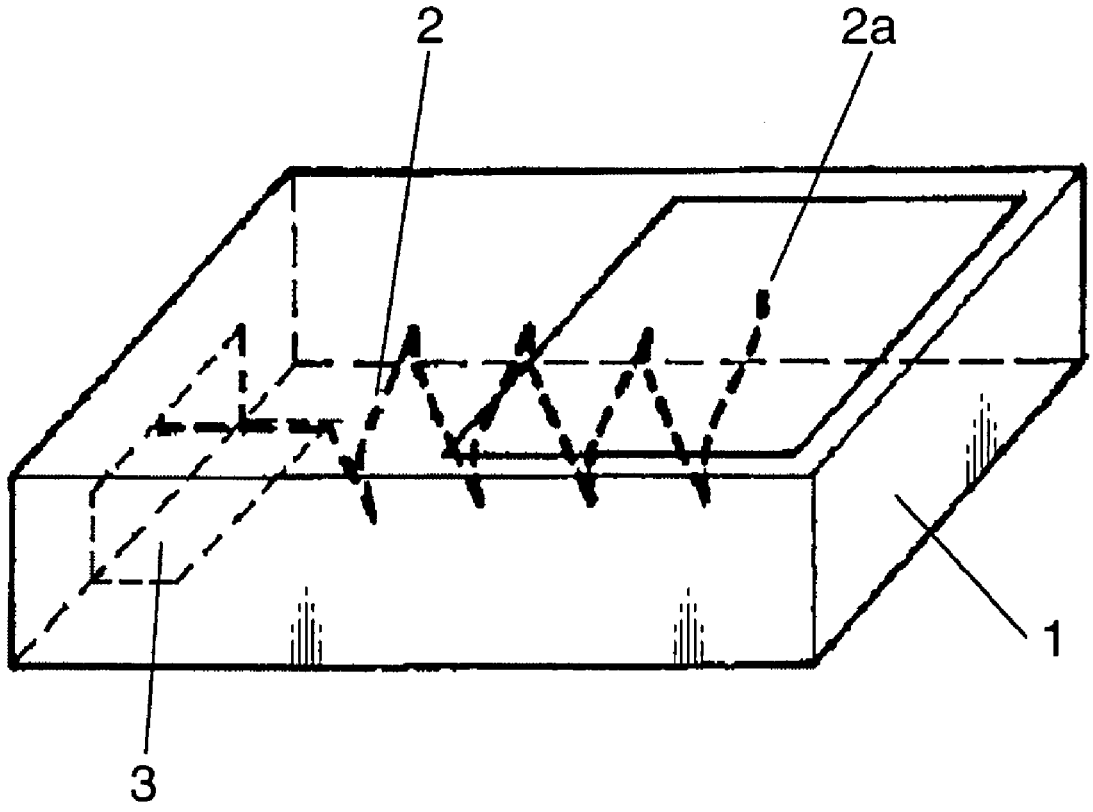
PRIOR ART FIG.7
FIG. 7 is a perspective view of a prior art antenna.

Although the radiation conductor 7 whose electrical length is $\lambda/4$ is described in the foregoing embodiment, similar functions and effects can be obtained even with the radiation conductor 7 whose electrical length is a well-known wavelength size such as $\lambda/2$, $3\lambda/8$, $5\lambda/8$, etc. In a case of $\lambda/2$, the magnetic section 10 is arranged at a side corresponding to the power supply portion side 7*b* of the $\lambda/4$ radiation conductor 7, and the dielectric sections 9 are arranged at the other ends corresponding to the open end side 7*a* of the $\lambda/4$ radiation conductor 7 as shown in FIG. 6. With this construction, the dielectric section 9 is provided on open ends 7*a*, 7*a* where the voltage distribution of the $\lambda/2$ radiation conductor 7 is larger and the quantity of electric energy in the $\lambda/2$ radiation conductor 7 is larger. The magnetic section 10 is provided on the power supplier 8 side of the $\lambda/2$ radiation conductor 7 where the current distribution is larger and the quantity of magnetic energy is larger. Thus, similar functions and effects can also be obtained in the above antenna having two open ends 7*a*, 7*a* of the radiation conductor 7.

Although the antenna for VHF/UHF bands is described in the foregoing embodiment, similar functions and effects can be obtained even for other bands such as HF, SHF, etc. by choosing appropriate physical lengths in the dielectric section and in the magnetic section, or by selecting a dielectric material having an appropriate relative permittivity and a magnetic material having an appropriate relative magnetic permeability.

As described above, an inventive antenna comprises: a radiation conductor; a basebody provided on the radiation conductor, and including a dielectric section made of a dielectric material and a magnetic section made of a magnetic material; and a power supplier connected to the radiation conductor, wherein: the magnetic section is provided on a part where a current distribution of the radiation conductor is higher, and the dielectric section is provided on a part where a voltage distribution of the radiation conductor is higher.

Preferably, the above antenna further comprises an interference section provided between the dielectric section and the magnetic section and having permittivity and permeability lower than those of the dielectric section and the magnetic section. In this case, the interference section makes the electric power transfer smooth in the radiation conductor, thereby suppresses the deterioration of the radiation characteristic of the antenna.

Further, the above interference section is more preferably made of an organic resin. This material is suitable for the interference section because it has an appropriate level of both permittivity and permeability.

Still further, the above interference section is much more preferably made of a resin adhesive. This material is more suitable for the interference section because it has both an adhesive function and an interference section function.

The present invention relates to an antenna for use in various radio communications apparatuses and has an effect of being suited for miniaturization. Particularly, the present invention is usefully applied to an antenna for use in a mobile terminal such as a mobile phone instrumented with an analog television or a digital television.

This application is based on Japanese patent application serial No. 2004-076219, filed in Japan Patent Office on Mar. 17, 2004, the contents of which are hereby incorporated by reference.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims. The expression of "X is provided on Y" includes not only "X contacts with Y" but also "X faces Y with a clearance in the range of an effective magnetic or electric field" in this specification.

What is claimed is:

1. An antenna comprising:

a radiation conductor;

a basebody directly bearing on the radiation conductor, the basebody including a dielectric section made of a dielectric material and a magnetic section made of a magnetic material, wherein the magnetic section is provided at a position where a current distribution of the radiation conductor is higher, and the dielectric section is provided at a position where a voltage distribution of the radiation conductor is higher;

a power supplier connected to the radiation conductor; and an interference section provided between the dielectric section and the magnetic section, wherein the interference section has a permittivity and a permeability lower than a permittivity and a permeability of the dielectric section and the magnetic section.

2. The antenna according to claim 1, wherein the interference section is made of an organic resin.

3. The antenna according to claim 2, wherein the interference section is made of a resin adhesive.

4. The antenna according to claim 1, wherein the radiation conductor is wound around an outer surface of the basebody.

5. The antenna according to claim 1, wherein the dielectric section is a physical section.

6. The antenna according to claim 1, wherein the magnetic section is a physical section.

* * * * *